US011136847B2

(12) United States Patent
Emerson

(10) Patent No.: US 11,136,847 B2
(45) Date of Patent: Oct. 5, 2021

(54) REUSABLE FIELD-ATTACHABLE WELLHEAD PENETRATOR AND METHOD OF ASSEMBLY AND USE

(71) Applicant: Quick Connectors, Inc., Houston, TX (US)

(72) Inventor: Tod D. Emerson, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 260 days.

(21) Appl. No.: 16/085,519

(22) PCT Filed: Mar. 15, 2017

(86) PCT No.: PCT/US2017/022590
§ 371 (c)(1),
(2) Date: Sep. 14, 2018

(87) PCT Pub. No.: WO2017/161048
PCT Pub. Date: Sep. 21, 2017

(65) Prior Publication Data

US 2020/0291736 A1 Sep. 17, 2020

Related U.S. Application Data

(60) Provisional application No. 62/308,649, filed on Mar. 15, 2016.

(51) Int. Cl.
*E21B 33/038* (2006.01)
*E21B 17/02* (2006.01)
*E21B 43/112* (2006.01)

(52) U.S. Cl.
CPC ..... *E21B 33/0385* (2013.01); *E21B 17/0285* (2020.05); *E21B 43/112* (2013.01)

(58) Field of Classification Search
CPC . E21B 33/0385; E21B 17/0285; E21B 43/112
(Continued)

(56) References Cited

U.S. PATENT DOCUMENTS 3,945,700 A 3/1976 Didier
4,708,201 A 11/1987 Reed
(Continued)

FOREIGN PATENT DOCUMENTS

WO 97/39506 A1 10/1997
WO 2014/185958 A1 11/2014
WO 2014185958 A1 11/2014

OTHER PUBLICATIONS

Extended European Search Report dated Feb. 13, 2020, EP Application No. 17767477, pp. 1-12.
(Continued)

*Primary Examiner* — Matthew R Buck
*Assistant Examiner* — Patrick F Lambe
(74) *Attorney, Agent, or Firm* — MH2 Technology Law Group LLP

(57) ABSTRACT

The plug in, re-useable field-attachable wellhead penetrator provides an economic means of attachment of continuous electrical conductors through a wellhead. A rubber seal and non-ferromagnetic guide are retained on the upper end of the mandrel allowing the conductors extending there through to be connected to electrical sockets then inserted in an insulating block. Epoxy can be used within the mandrel and is easily removed because the inner diameter of the mandrel is coated with tetrafluoroethylene or other slick coatings.

20 Claims, 1 Drawing Sheet

(58) Field of Classification Search
USPC ..... 166/338
See application file for complete search history.

(56) References Cited

U.S. PATENT DOCUMENTS

| | | | | |
|---|---|---|---|---|
| 4,728,296 | A * | 3/1988 | Stamm | E21B 17/028 439/275 |
| 6,561,268 | B2 * | 5/2003 | Jones | H01R 13/2421 166/338 |
| 6,688,386 | B2 * | 2/2004 | Cornelssen | E21B 33/0407 166/65.1 |
| 8,382,508 | B1 * | 2/2013 | Frey | H01R 13/5205 439/461 |
| 2002/0070030 | A1 * | 6/2002 | Smith | E21B 33/0407 166/379 |
| 2008/0186155 | A1 | 8/2008 | Emerson | |
| 2010/0065302 | A1 * | 3/2010 | Nesbitt | E21B 17/028 174/116 |
| 2011/0017510 | A1 | 1/2011 | Emerson | |
| 2014/0110164 | A1 | 4/2014 | Emerson | |
| 2019/0119990 | A1 * | 4/2019 | Fredriksen | E21B 17/0285 |

OTHER PUBLICATIONS

Ivan Kecman, Partial Supplementary European Search Report dated Oct. 14, 2019, EP Application No. 17167477.7, pp. 1-14.

* cited by examiner

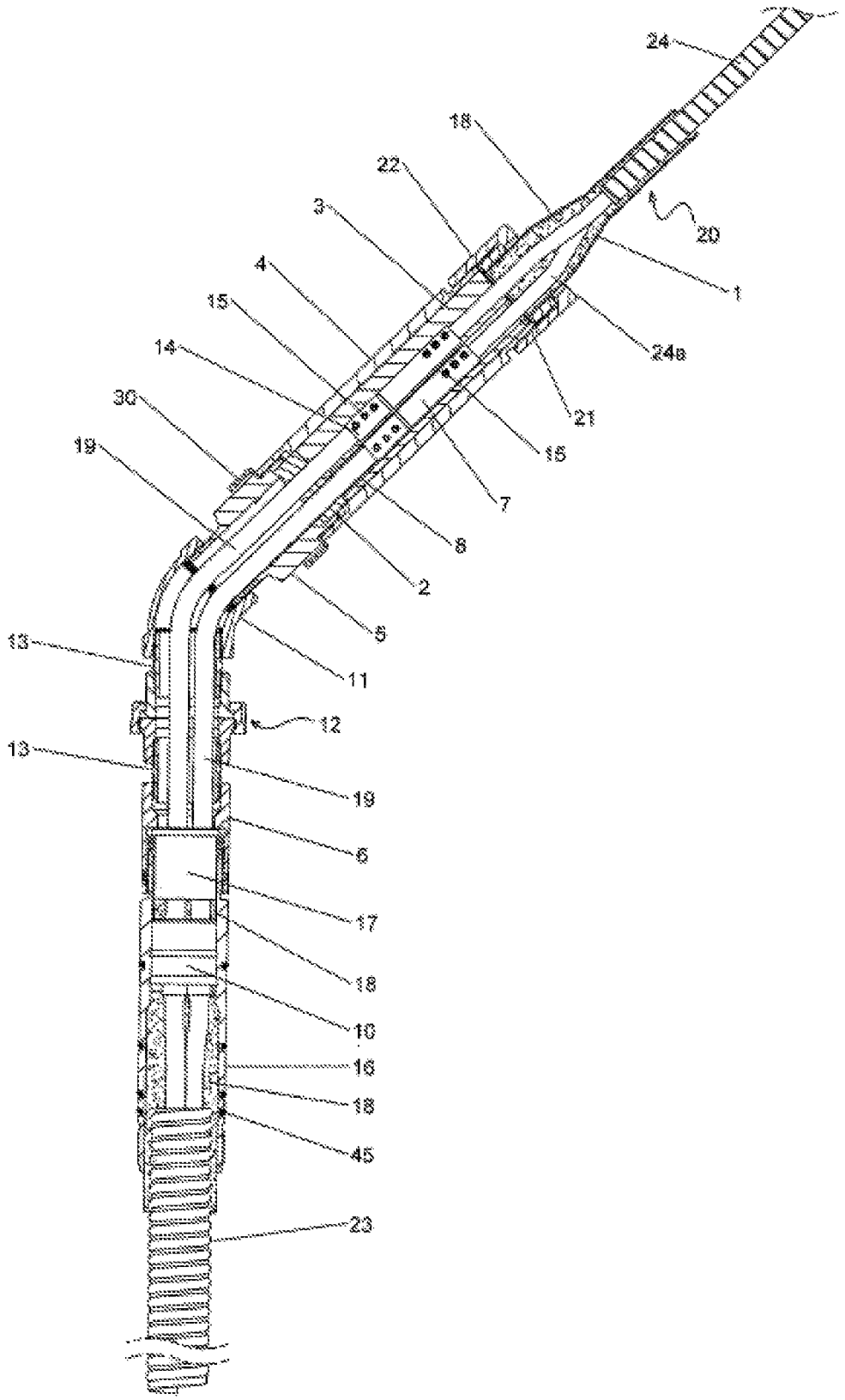
24
18
22
3
20
4
1
15
24a
14
21
30
16
19
7
8
2
5
13
11
12
13
19
6
17
18
10
16
18
45
23

REUSABLE FIELD-ATTACHABLE WELLHEAD PENETRATOR AND METHOD OF ASSEMBLY AND USE

FIELD OF INVENTION

The present application relates to a wellhead penetrator allowing the transmission of electrical energy though a wellhead to supply an electric submersible pump, or to heat mineral insulated cable within the wellbore. More specifically, this application describes a sealed wellhead penetrator which may be reused while remaining capable of use on any number of existing wellhead penetrator mandrels currently on the market.

BACKGROUND OF THE INVENTION

The delivery of electrical service within a well creates a variety of problems. Ideally, the conductors coming from the electrical submersible pump (ESP) should continue through the wellhead to a surface power supply or junction. Utilizing splices of electrical cables within the wellbore often leads to disastrous short circuits because of the effect of vapors on the splice materials. The present invention allows a continuous cable run through a wellhead and provides a seal to the mandrel penetrating wellhead. Any number of existing mandrel penetrators may be retrofitted and reused for this purpose. This low-cost alternative to existing penetrator systems is therefore useful and provides a means of rapidly providing a new electrical connection for ESP or heater cable installations for the oil fields of the world.

SUMMARY OF THE CLAIMED INVENTION

The wellhead penetrator system described in this application comprises a tubular mandrel insertable in a wellhead providing threads on an upper end extending from the wellhead permitting the passage of a plurality of electrical conductors used to power a electric submersible pump or a mineral insulated heater cable through the wellhead. A plug-in wellhead penetrator system can comprise a plurality of electrical conductors extending through a wellhead; means for attaching each electrical conductor to a surface cable electrical conductor; and, means for connecting a sealed electrical conductor non-conductive protective sleeve enclosing the electrical conductors extending from the well to the surface electrical conductors.

This system specifically features an insertable tubular mandrel in a wellhead providing threads on an upper end extending from the wellhead allowing the passage of a plurality of electrical conductors used to power an ESP through the wellhead; a rubber seal enclosing each of the electrical conductors inserted in the upper end of the mandrel; a non-ferromagnetic guide enclosing each of the electrical conductors extending from the rubber seal within the upper end of the tubular mandrel; an offset coupling attached to the upper end of the tubular mandrel having an internal shoulder compressing the non-ferromagnetic guide and providing internal threads to attach to the mandrel and tapered internal threads on an upper end of an offset connector; a housing having tapered outer threads for connection to the offset coupling; a polymeric insulator block providing a least three internal paths inserted in the housing; and, a transition collar lock nut for retaining the polymeric insulator block and a transition cable connection providing a bottom ring for locking the transition cable connection within the housing.

The housing of the wellhead penetrator system can be vented. The offset coupling can be angled at 10°, 45° or 90° to permit clearance of the wellhead and flanges located on the wellhead. Moreover, the tubular mandrel can be internally-coated with tetrafluoroethylene or other slick components to allow the mandrel to be cleaned of epoxy or other materials used to complete the seal.

The wellhead penetrator system can be assembled using epoxy packed between the non-ferromagnetic guide and the rubber seal. Alternatively, epoxy can be packed around an armored cable inserted into the tubular mandrel and the stripped ends of the conductors extending from the armored cable to the rubber seal.

The present application also claims a method for installation of a plug in, re-useable, field available, wellhead penetrator by fabricating a pigtail from an ESP cable into a cable transition body and attaching it to conductors extending from the wellhead by: stripping an armored cable exposing the plurality of insulated conductors; attaching sockets to the end of the conductors; affixing the socketed conductors extending through the transition collar to the electrical conductors extending from the well head; and moving the insulator block, which can be composed of tetrafluoroethylene, polyether ether ketone (PEEK), or polyoxymethylene, or other suitable substitutes to cover each of the connectors; and locking the insulator block within the housing by screwing the transition collar lock-nut onto the housing.

BRIEF DESCRIPTION OF THE DRAWINGS

FIG. 1 is a cross-sectional view of one embodiment of the plug in, re-usable wellhead penetrator.

DESCRIPTION OF THE APPARATUS

FIG. 1 shows a cross-sectional view of one embodiment of the claimed invention. An ESP cable 23, which can be either round or flat metal clad CLX cable, is preferably continuous from the ESP in the wellbore and is inserted into the down-hole side of a wellhead mandrel 16. The wellhead mandrel 16 provides threads onto which is affixed a connection nipple 6 at the surface. The armored cable 23 is pre-stripped from each electrical conductor 19 (only two of the three normally found are shown in this view) in a length approximately one-half of the length of the mandrel 16. Each leg of the three electrical conductors 19 is fed through a compressible rubber seal 10 fabricated from ethylene propylene diene monomer (EPDM), and inserted in a non-ferromagnetic guide 17. The non-ferromagnetic guide 17 of this embodiment is made of brass coated with electroless nickel plating. An epoxy 18 is packed around each leg of the conductors 19 before they enter the rubber seal 10 and between the rubber seal 10 and the non-ferromagnetic guide 17. Additionally, the are a plurality of O-rings 45 to seal against the wellhead on the outside of the mandrel 16. The adapter nut or connection nipple 6 can be no larger than the outer diameter of the mandrel 16 itself. Epoxy 18 can be applied on the upper interior end of the mandrel. Epoxy 18 may be placed on each side of the rubber seal 10 or just on the down hole side of the rubber seal 10. The non-ferromagnetic guide 17 is inserted on the interior of the mandrel 16 and retained there by offset coupling or connection nipple 6. Alternatively, a mandrel lock nut could be screwed onto the threads shown on the mandrel 16. The alternative placement of epoxy 18 on the interior of the mandrel covering both the end of the armored ESP cable supports the extending conductor coming through the armored cable 23 and the rubber seal 10 from rapid decompression. Since the interior of mandrel 16 is intended to be coated with tetrafluoroethylene or other slick components, epoxy 18 can be readily removed from the mandrel 16 allowing its reuse as a wellhead penetrator. The entire assembly can also be packed with DC-4 or DC-11 silicone compound (both insulating products of Dow Corning) adding to the ease of removal while maintaining an insulated passage for the conductors through the wellhead.

Outside the wellhead, a surface cable 24 is inserted through a transition collar 1 and stripped of armoring. The armor-stripped surface conductors 24*a*, are further stripped of insulation and inserted into sockets 7. The field-fabricated pigtail 20 can be fashioned from either flat or round ESP cable or CLX cable as available. For flat cable, the F-T-R (flat to round) transition collar 1 is packed with epoxy 18 providing a secure and insulated connection. Sockets 7 installed on the pig-tail conductors 24*a* coming through the transition collar 1 can be either attached with set screws 15 or crimped on the stripped ends of each conductor.

Each leg of the conductor 19 extending through the wellhead mandrel 16 is then inserted through a threaded nipple 13 which in turn is threadably attached to the wellhead nipple 6 on the wellhead side and through a union assembly 12 compressed against a second threaded nipple 13. An elbow 11 of the needed degree depending on the wellhead clearance is then threaded onto the union assembly 12.

In the embodiment shown the electrical conductors 19 extending through the wellhead are inserted through an EPDM spacer 2 and into tubes 8, carried within the insulator housing 4 restrained at its bottom by the vented insulator housing adapter 5. Each of the insulated electrical conductors 19 extending through the wellhead (not shown in this view) is then stripped and an EDC connector pin 14 is attached to the stripped conductor 19 with set screws 15. The installer will then insert the pins 14 into the prepared pigtail connectors 7 and move each into the insulator block or sleeve 3.

The vented insulator housing adapter 5 is threaded to the elbow. The sockets 7 are then covered by insulator block 3. The transition collar 1 also provides a shoulder 21 that is formed by welding to a standard transition collar. A transition collar lock nut 22 is then threaded on the housing 4 retaining the conductors 24*a* and insulator 3. The housing 4 is further sealed to the elements by a vent hood 30 capping the vented insulator housing adapter 5. Vent holes can be formed anywhere above the cable seal 10 to permit gas coming through the mandrel system to prevent migration down the surface cable 24. Tightening the transition cable to housing lock nut 22 completes the installation.

The invention claimed is:

1. A wellhead penetrator system comprising:

a tubular mandrel insertable in a wellhead providing threads on an upper end extending from the wellhead permitting the passage of a plurality of electrical conductors used to power an electric submersible pump through the wellhead;

a rubber seal enclosing each of the electrical conductors inserted in the upper end of the mandrel;

a non-ferromagnetic guide enclosing each of the electrical conductors extending from the rubber seal within the upper end of the tubular mandrel;

an offset coupling attached to the upper end of the tubular mandrel, the offset coupling having an internal shoulder compressing the non-ferromagnetic guide and providing internal threads to attach to the mandrel, and an offset connector providing tapered internal threads on an upper end thereof, wherein the offset connector comprises an elbow defining a bend such that an upper end of the offset coupling is both laterally and axially offset from a lower end of the offset coupling;

a housing having tapered outer threads for connection to the offset coupling;

a polymeric insulator block providing a least three internal paths inserted in the housing; and, a transition collar lock nut for retaining the polymeric insulator block and a transition cable connection providing a bottom ring for locking the transition cable connection within the housing.

2. The wellhead penetrator system of claim 1 wherein the housing is vented.

3. The wellhead penetrator system of claim 1 wherein the offset coupling is angled at 45°.

4. The wellhead penetrator system of claim 1 wherein the offset coupling is angled at 90°.

5. The wellhead penetrator system of claim 1 wherein the offset coupling is angled at 10°.

6. The wellhead penetrator system of claim 1 wherein the tubular mandrel is internally coated with tetrafluoroethylene.

7. The wellhead penetrator system of claim 6 further comprising epoxy packed around an armored cable inserted into the tubular mandrel and the stripped ends of the conductors extending from the armored cable to the rubber seal.

8. The wellhead penetrator system of claim 1 further comprising epoxy packed between the non-ferromagnetic guide and the rubber seal.

9. The wellhead penetrator system of claim 1, wherein the housing comprises a housing adapter that has the outer threads that connect to the internal threads of the offset connector of the offset coupling, and wherein the housing is not positioned within the mandrel.

10. The wellhead penetrator system of claim 9, wherein the offset coupling comprises a connection nipple having the shoulder that presses into the non-ferromagnetic guide, wherein the elbow is connected to the housing adapter.

11. The wellhead penetrator system of claim 10, wherein the offset coupling further comprises a first threaded nipple connected to the connection nipple, a second threaded nipple connected to the elbow, and a union assembly that connects together the first and second nipples.

12. A wellhead penetrator system, comprising:

a tubular mandrel configured to be inserted in a wellhead so as to permit passage of an electrical conductor therethrough to power an electric submersible pump through the wellhead;

a rubber seal positioned in mandrel and configured to receive the electrical conductor therethrough;

a non-ferromagnetic guide positioned in the mandrel and through which the electrical conductor extends;

an offset coupling configured to receive the electrical conductor therethrough, the offset coupling comprising:

a connector nipple attached to an outside of the mandrel, the connector nipple comprising an internal shoulder configured to engage an end of the non-ferromagnetic guide; and an elbow coupled to the connector nipple, wherein the elbow defines a bend such that an upper end of the offset coupling is both laterally and axially offset from a lower end of the offset coupling; and a housing having connected to the offset coupling and configured to receive the electrical conductor therethrough.

13. The wellhead penetrator system of claim 12, further comprising:

a polymeric insulator block defining an internal path and positioned in the housing; and a lock nut for retaining the polymeric insulator block and a transition cable connection providing a bottom ring for locking the transition cable connection within the housing.

14. The wellhead penetrator system of claim 12, wherein an epoxy-filled gap is defined within the mandrel and between the seal and the non-ferromagnetic guide, the epoxy-filled gap containing epoxy configured to seal the electrical conductor in the seal.

15. The wellhead penetrator system of claim 12 the upper end of the offset coupling being coupled to the housing and the lower end of the offset coupling being provided by the connector nipple and coupled to the mandrel.

16. The wellhead penetrator system of claim 15, wherein the offset coupling further comprises one or more threaded nipples connecting the elbow to the connector nipple.

17. The wellhead penetrator system of claim 12, wherein the housing comprises a housing adapter connected to the offset coupling, and wherein the electrical conductor is received through the housing adapter.

18. The wellhead penetrator system of claim 17, wherein the housing adapter is vented.

19. The wellhead penetrator system of claim 12, wherein the connector nipple is threaded onto the outside of the mandrel at an upper end of the mandrel.

20. The wellhead penetrator system of claim 12, wherein the electrical conductor comprises three leads that extend through the housing and the mandrel.

* * * * *